United States Patent [19]

Seamon

[11] 4,111,078

[45] Sep. 5, 1978

[54] EXTRACTOR FOR PLASTIC RISERS

[76] Inventor: Paul Seamon, 6191 Anthony Ave., Garden Grove, Calif. 92645

[21] Appl. No.: 783,983

[22] Filed: Apr. 4, 1977

[51] Int. Cl.[2] ..... B25B 13/48

[52] U.S. Cl. ..... 81/71

[58] Field of Search ..... 81/71, 53.2

[56] References Cited

U.S. PATENT DOCUMENTS

| | | | |
|---|---|---|---|
| 1,688,460 | 10/1928 | Fowler | 81/71 |
| 1,754,736 | 4/1930 | Bryant | 81/71 |
| 2,106,741 | 2/1938 | Herbert | 81/71 |
| 2,244,824 | 6/1941 | Caminez | 81/71 |
| 3,216,292 | 11/1965 | Flegal | 81/53.2 |

*Primary Examiner*—James L. Jones, Jr.

*Attorney, Agent, or Firm*—Edgar W. Averill, Jr.

[57] ABSTRACT

A device for extracting plastic risers from fittings such as polyvinyl-chloride water sprinkler pipes. The device has at least two gripping edges for gripping the inner surface of the threaded fitting. At least one of the gripping edges has a plurality of serrations formed along its extremity.

4 Claims, 5 Drawing Figures

10
11
12
13
14
15
16
17
20
21
22
23
24
25
a
30
31
32
33
34
35
40
41
42
43

EXTRACTOR FOR PLASTIC RISERS

BACKGROUND OF THE INVENTION

The field of the invention is plumbing devices and the device is more particularly useful for unscrewing plastic risers of the type commonly used in low pressure water piping such as lawn sprinkler piping.

A device of this general type is disclosed in applicant's U.S. Pat. No. 3,952,618. Although such device is very effective and has been widely accepted, it is important that the edges be sharp. In the event the edges are rounded in manufacturing, the device may slip in the fitting and not grip the fitting sufficiently to unscrew it. This is especially true where the fitting is particularly tightly jammed in the tee.

SUMMARY OF THE INVENTION

The present invention is for an improved extractor for unscrewing plastic risers from a threaded fitting such as an underground tee located in a sprinkler pipe. The extractor has a shank with at least two gripping edges which fit within the riser to be unscrewed. The shank is attached to a handle by an extention rod. The improvement comprises a plurality of serrations formed along the extremity of at least one of the gripping edges.

DESCRIPTION OF THE PREFERRED EMBODIMENTS

Figures 1, 2, 3, 4, 5:
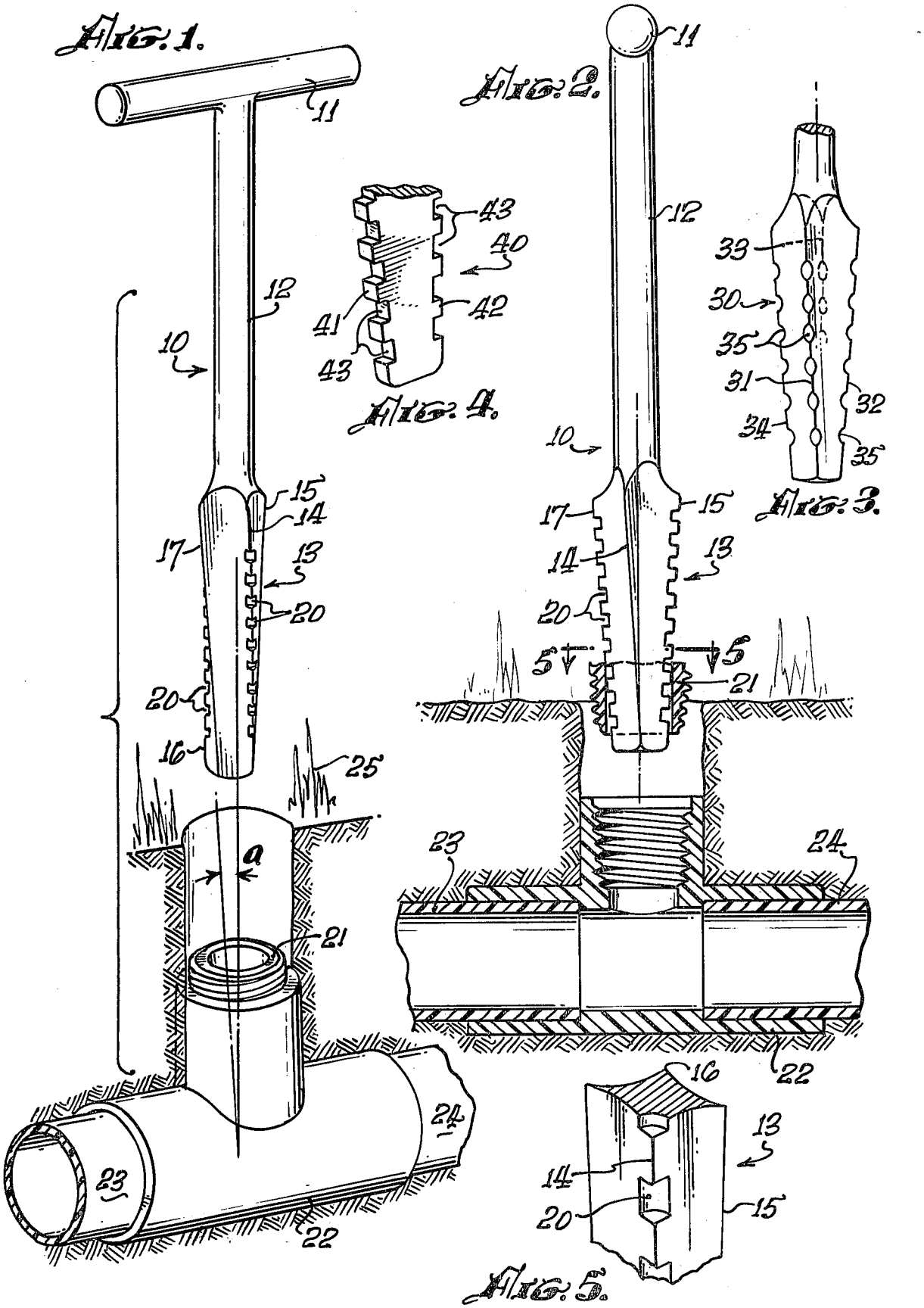
FIG. 1 is a perspective view of the device of the present invention together with a subterranean tee and riser assembly.
FIG. 2 is a side view, partly in cross-section of the device and tee of FIG. 1.
FIG. 3 is a fragmentary perspective view of an alternate embodiment of the device of FIG. 1.
FIG. 4 is a fragmentary perspective view of an alternate embodiment of the device of FIG. 1.
FIG. 5 is a fragmentary perspective view sectioned on a plane as viewed along line 5—5 of FIG. 2.

The device of the present invention is shown in perspective view in FIG. 1 and indicated by reference character 10. The device or extractor 10 has a handle 11 and a rod 12 which connects the handle to a shank 13. Shank 13, as shown more clearly in FIG. 5, has four gripping edges 14 through 17. Two of the gripping edges, namely edges 14 and 16 have a plurality of serrations indicated by reference character 20. The serrations may be cast or cut or otherwise formed into the gripping edge and have been found to substantially increase the gripping strength of the extractor along the inner surface of a riser.

A broken riser 21 is shown in FIG. 1 and is threaded into a tee 22. The tee 22 is glued to two lengths of pipe 23 and 24. These pipes and the tee, as well as the broken riser, are held below the surface of a lawn which is indicated by reference character 25.

The edges of the extractor 10 are tapered and form an angle of between 1.5° and 5° with respect to the central axis of the extractor. This angle is indicated in FIG. 1 by the letter "a". The edges also have a slight reverse spiral or twist of about 12° per inch of shank length.

In use, the extractor 10 is inserted into the broken riser 21 and turned in a counter clockwise direction as viewed from above. The broken riser is gripped by the four gripping edges and particulary the two serrated gripping edges and is held in the extractor as it is unscrewed from tee 22. The broken riser is then gripped by shank 13 as shown in FIG. 2.

The extractor may be sand cast or injection molded or otherwise formed from a material which is harder than the broken riser and strong enough to unscrew a tightly inserted riser. Aluminum has proved successful in this use but the device could also be formed from a relatively rigid polymer or from steel.

The method for forming the serrations in one or more of the gripping edges will depend upon the material from which the extractor is formed as well as the method used to fabricate the extractor. If the tool is injection molded the serrations may be formed in the mold. If the tool is sand cast it is preferable that the serrations be formed by cutting into the edge.

One particularly effective type of serration was formed by a hardened steel slitter which was used to cut a series of nine kerfs along two opposing edges of an extractor of the type shown in FIGS. 1 and 2. Each kerf has two sides which are in a plane perpendicular to the longitudinal axis of the tool. The back edge of each kerf is parallel to the longitudinal axis of the tool. The shank of the tool was about two inches in length and each kerf was about 3/32nds of an inch deep and 3/32nds of an inch wide.

An alternate embodiment of the improved device of the present invention is shown in FIG. 3. The shank 30 has four cutting edges 31, 32, 33 (not shown) and 34. A plurality of serrations 35 are formed in each of the cutting edges. Serrations 35 are semi-circular in cross-section as viewed from the edge of extractor 30.

Another form of the device of the present invention is shown in FIG. 4 and the shank of the tool is indicated generally by reference character 40. Shank 40 has two gripping edges 41 and 42 and is formed from a bar of steel or other appropriate material. The serrations, indicated by reference character 43 may be formed by stamping, cutting or the like. Instead of being rectangular or circular in cross-section the serrations or kerfs may be V shaped or other cross-sectional shape as long as a portion of the original gripping edge remains. The essential feature is that there be a plurality of kerfs or serrations formed in at least one gripping edge.

It has been found that the addition of serrations to a tool for unscrewing plastic risers not only increases the grip of the tool on the broken riser but also helps to hold the broken riser after it has been unscrewed from the tee. It is not necessary that all edges of the tool be serrated and one edge, two edges or any number of edges may be serrated. It is preferable however that at least two edges be serrated and it is also preferable that the two serrated edges be two opposing edges rather than two adjacent edges. It has been found that the serrating of all four edges of a tool such as that shown in FIG. 1 only slightly improves the grip strength from serrating two of the edges.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. A device of the type for unscrewing plastic risers from threaded fittings such as a tee located in a sprinkler pipe, said device having a continuously tapered shank with four gripping edges, each gripping edge having a pointed ridge at its extremity, an extension rod affixed to said shank and handle means affixed to said extension rod, wherein the improvement comprises:

a plurality of serrations formed along the extremity of at least one of said gripping edges, said serrations having two sides in a plane perpendicular to the longitudinal axis of the device and one edge parallel to the longitudinal axis.

2. The device of claim 1 wherein two of said four gripping edges have a plurality of said serrations thereon.

3. The device of claim 2 wherein said serrations are positioned on opposing edges.

4. The device of claim 1 wherein said plurality of serrations are positioned on each of said four gripping edges.

* * * * *